US006039086A

United States Patent [19]

Dornier et al.

[11] Patent Number: 6,039,086

[45] Date of Patent: Mar. 21, 2000

[54] SEPARATING WEFT THREAD WASTE OF A SINGLE UNCONTAMINATED MATERIAL FROM UNTWISTED LENO BINDING THREADS IN TRIMMED CATCH SELVAGES

[75] Inventors: Peter D. Dornier, Nonnenhorn; Valentin Krumm, Hergensweiler, both of Germany

[73] Assignee: Lindauer Dornier Gesellschaft mbH, Lindau, Germany

[21] Appl. No.: 09/165,790

[22] Filed: Oct. 2, 1998

[30] Foreign Application Priority Data

Oct. 2, 1997 [DE] Germany ..... 197 43 611
Oct. 2, 1997 [DE] Germany ..... 197 43 612

[51] Int. Cl.[7] ..... D03C 7/04; D03D 47/40; D03J 1/04

[52] U.S. Cl. ..... 139/54; 139/302

[58] Field of Search ..... 139/54, 302

[56] References Cited

U.S. PATENT DOCUMENTS

| | | | |
|---|---|---|---|
| 3,556,164 | 1/1971 | Golobart | 139/302 |
| 4,549,582 | 10/1985 | Küng et al. . | |
| 4,691,743 | 9/1987 | Venot | 139/302 |
| 4,894,276 | 1/1990 | Bryant | 139/302 |
| 5,518,039 | 5/1996 | Haeussler et al. . | |
| 5,560,400 | 10/1996 | Meyns et al. . | |
| 5,735,316 | 4/1998 | Hehle | 139/302 |

FOREIGN PATENT DOCUMENTS

| | | |
|---|---|---|
| 0127719 | 12/1984 | European Pat. Off. . |
| 0681044 | 11/1995 | European Pat. Off. . |
| 29708758 U | 9/1997 | Germany . |
| 6-49748 | 2/1994 | Japan . |

*Primary Examiner*—Andy Falik
*Attorney, Agent, or Firm*—W. F. Fasse; W. G. Fasse

[57] ABSTRACT

A method and an apparatus serve to process a catch selvage that has been trimmed from a web being woven on a loom, so as to separate weft thread ends and leno threads from the catch selvage to produce a type-pure weft thread waste and a type-pure leno thread waste or reusable leno threads. The term "type-pure" refers to a waste material containing a single uncontaminated type or color of thread material, e.g. wool vs. synthetic or blue vs. red. After the catch selvage (1) has been trimmed from the edge (11) of the woven web (2), the leno threads (4, 4') are untwisted from each other by being rotated by an untwisting apparatus (5) in a direction opposite the binding twist applied by the leno device (18). Thereby, the full leno binding (1A) is completely unbound and opened, so as to release the weft thread ends (3A), which are then sucked into a proper one of weft waste collection containers (6B) by a suction pipe (6A), so that only a single type-pure and/or color of weft thread end is collected in each container (6B). The unbound leno threads (4) are collected as a type-pure waste or are rewound on spools to be reused. Alternatively, by using endless closed-loop leno threads (4'), the leno threads (4') are continuously recirculated back to the leno device (18), without intermediately being wound onto spools.

34 Claims, 3 Drawing Sheets

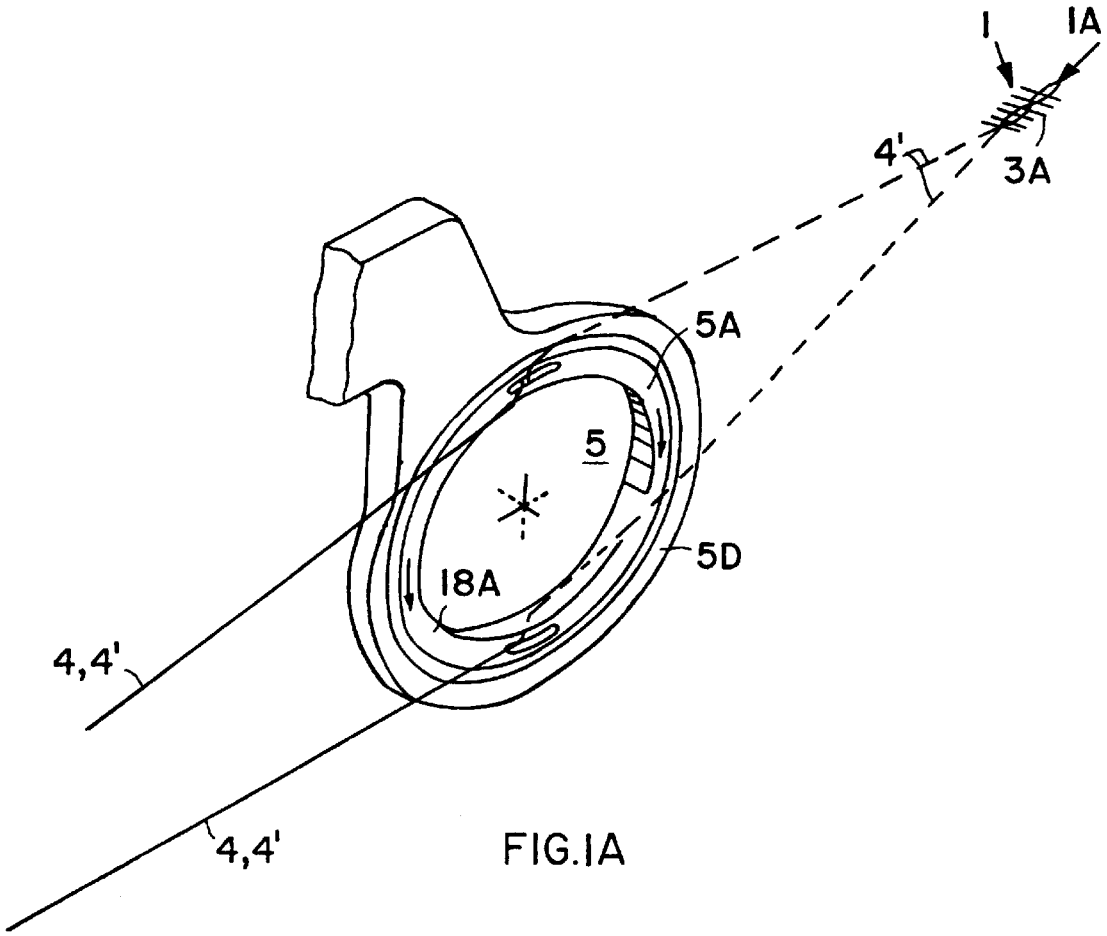
FIG.IA

SEPARATING WEFT THREAD WASTE OF A SINGLE UNCONTAMINATED MATERIAL FROM UNTWISTED LENO BINDING THREADS IN TRIMMED CATCH SELVAGES

CROSS-REFERENCE TO RELATED APPLICATION

The present application is related to pending U.S. application Ser. No. 09/078,338, filed on May 13, 1998, pending the disclosure of which is incorporated herein by reference.

PRIORITY CLAIM

This application is based on and claims the priorities under 35 U.S.C. §119 of German Patent Applications 197 43 611.0-26 and 197 43 612.9-26 both filed on Oct. 2, 1997. The entire disclosures of both priority applications are incorporated herein by reference.

FIELD OF THE INVENTION

The invention relates to a method and an apparatus for producing a type-pure weft thread waste during the production of woven webs on looms, and for selectively reusing the catch selvage warp threads of a catch selvage that has been formed by a rotating leno device. Throughout this specification, the term type-pure refers to a waste material containing a single uncontaminated type or color of thread material, e.g. wool vs. synthetic or blue vs. red.

BACKGROUND INFORMATION

It is generally known to form a catch selvage along the edge of a web being woven on a loom, for example using a rotating leno device to bind in the weft thread ends along the edges of the web using leno threads, so as to hold together the thread ends and hold the weft threads under proper tension. Once the weaving process has been completed, the catch selvage is trimmed from the edges of the woven web to form the finished cloth. The catch selvage material has therefore typically become waste.

If the weft thread material is of a different type than the catch selvage warp threads such as leno threads, then the trimmed catch selvage will include a mixture of different materials, which makes it difficult or impossible to reuse or recycle the catch selvage waste material. It is often the case that the leno threads comprise a different material than the weft threads, especially when the weft material is a high-cost, high-value material and/or a sensitive material with a low tensile strength that is subject to breaking. In these situations, the catch selvage warp threads, and particularly the leno threads, will be made of a stronger and/or lower cost material. The prior art has not provided any satisfactory and effective methods or apparatus for processing the trimmed catch selvage in such a manner so as to produce a type-pure weft thread waste separated from the leno threads.

European Patent Application 0,127,719, published on Dec. 12, 1984 discloses an apparatus for pulling or drawing off an auxiliary selvage, which is designated as a fabric list selvage or as catch selvage as the case may be, and which has been trimmed from the edge of a woven web produced on a loom. The apparatus is arranged near the web draw-off roller of the loom and comprises an auxiliary selvage drawing-off channel equipped with an injector nozzle. The auxiliary selvage, which comprises selvage warp and weft threads bound together, is trimmed from the edge of the web and is then pneumatically drawn off and conveyed into a waste container by means of the apparatus, without providing any measures to sort or separate the weft threads from the warp threads for the purpose of obtaining a type-pure waste directly at the loom.

European Patent Application 0,681,044, published on Nov. 8, 1995, discloses a method and an associated apparatus for drawing off the waste edges or the selvages of a woven web. The waste selvages formed along the edges of a web being woven on a loom are trimmed from the web and are then pulled between two driven drawing-off rollers that form a pulling nip for the waste selvage therebetween. The waste selvage is drawn through the rollers into a waste container. Thus, according to this reference, the waste selvage consisting of weft and warp materials bound together is drawn off and conveyed into a waste container by mechanical means, without carrying out any process for separating the materials in order to provide a type-pure weft material waste and a type-pure warp material waste directly at the loom.

German Utility Model 29,708,758 published on Sep. 11, 1997 discloses a loom including so-called rotational leno selvage forming devices for forming the fabric list edges and the catch selvages of a woven web being produced on the loom. According this reference, the rotational leno device twists or rotationally binds together two leno threads respectively to form the catch selvage and the fabric list edge. Thereby, the catch selvage which will become the waste selvage comprises only two leno threads binding together the weft thread ends. However, this reference does not disclose anything about the further processing or reuse of the catch selvage after it has been trimmed from the edge of the woven web.

Even using such a rotational leno device for forming the catch selvage, whereby it is possible to substantially reduce the number of catch selvage warp threads, it is still not possible to produce a type-pure waste in all situations, namely in situations using a different material for the leno threads relative to the weft threads as discussed above. Particularly in the case of weft yarns having a low tensile strength, such as a cashmere yarn or the like, such a cashmere yarn will not be used for the leno threads because this yarn is too weak in tensile strength and would lead to frequent leno thread breaks requiring stopping of the loom. In order to avoid such problems, up to the present day it has been typical to use a twisted wool thread as the leno thread. Such a twisted wool thread has a sufficient strength and quality to meet and exceed the requirements for use in a rotating leno device. However, such a wool thread will form a waste selvage that is not type-pure whenever the weft threads comprise a material other than twisted wool. The resultant mixed-type waste is less valuable and is not directly suitable for recycling or reuse in a spinning mill.

Furthermore, it has conventionally been necessary to supply the leno threads for a leno-bound catch selvage from respective leno thread spools. Additional processing steps and costs are involved in winding the leno threads onto the spools, storing the spools, handling the spools, mounting the spools on the loom for a particular weaving run, exchanging spools once they have been emptied, etc. The prior art has shown no suggestions toward totally avoiding the use of leno thread spools for supplying the leno threads.

SUMMARY OF THE INVENTION

In view of the above, it is an object of the invention to provide a method and an apparatus by means of which an absolutely type-pure weft thread waste can be recovered or separated from the catch selvages that are produced as waste in the weaving process, whereby the type-pure weft thread waste is 100% recyclable or reusable, and whereby the leno threads that have been used for forming the catch selvage can be selectively reused as leno threads for again forming a catch selvage. It is a further object of the invention to completely avoid the need of leno thread spools for supplying leno threads for forming the catch selvage. The invention further aims to avoid or overcome the other disadvantages of the prior art, and to achieve additional advantages, as apparent from the present description.

The above objects have been achieved in a method of processing a waste catch selvage that has been formed along the edge of a web being woven on a loom, according to the invention. The method includes a step of forming the catch selvage by binding the ends of the weft threads of the woven web with two leno threads using a rotational leno device to form a full leno binding, a step of trimming the catch selvage from the woven web after it has been formed, a step of untwisting the full leno binding from the catch selvage so as to release the weft thread ends therefrom, and then a step of separately conveying away the weft thread ends and the leno threads that have been separated from the catch selvage.

The above objects have further been achieved in an apparatus for processing a catch selvage according to the invention, including a loom process controller, a rotational untwisting apparatus for untwisting the full leno binding downstream from the point at which the catch selvage is trimmed from the edge of the woven web, a waste collection apparatus arranged between the rotational untwisting apparatus and the point at which the catch selvage is trimmed from the woven web, and a leno thread drawing-off apparatus arranged downstream of the rotational untwisting apparatus. Throughout this specification, the terms "upstream" and "downstream" relate to the direction of advancing motion of the woven web and of the leno threads, whereby "upstream" is the direction from which the leno threads come and "downstream" is the direction in which the leno threads go, and components may be described as "upstream" or "downstream" relative to each other with regard to the motion of the leno threads.

According to the inventive method and apparatus, after the catch selvage is trimmed from the edge of the woven web, the catch selvage is directed to a debinding or untwisting apparatus including a rotational member that receives and engages the leno binding threads, and then rotates so as to untwist or debind the full leno binding of the catch selvage. To achieve this, the rotational member of the untwisting apparatus rotates in a direction opposite the twisting direction of the leno device. For this purpose, the untwisting apparatus has a rotational drive that is connected to or at least controlled in correlation with the drive of the rotational leno device. A synchronous or an asychronous operation can be established between the rotational leno device and the rotational member of the catch selvage debinding or untwisting apparatus. Thereby it becomes possible for the first time to untwist and debind the full leno binding of a catch selvage that has been formed by means of a leno device, so as to release the weft thread ends that had been securely bound in by the leno threads.

Once the leno binding has been untwisted and the weft thread ends have been released, it is possible to draw off and collect the weft thread ends as a type-pure waste just upstream of the rotational member of the debinding or untwisting apparatus. The resulting type-pure weft thread waste can then be further processed as needed to be reused in a spinning mill. Since the weft thread waste will consist of one pure type of weft thread ends, the amount of further processing needed is greatly minimized or eliminated. The type-pure weft thread waste simply needs to be mechanically processed to provide fibers that can again be spun into a new thread.

A similar processing can be carried out for the waste leno thread to provide a pure leno thread waste or a reusable leno thread. For example, in the case of the leno thread consisting of a synthetic material, the leno thread waste may be collected and remelted to produce a type-pure leno thread waste output material. Alternatively, the leno threads that have been untwisted from the full leno binding can be re-wound onto spools and then reused as leno threads in the usual manner, or can be directly recirculated or fed back to the leno devices for reuse without intermediately being wound onto spools.

Due to the above mentioned synchronous or asynchronous operation of the untwisting apparatus relative to the rotational leno device, it is possible to untwist or unbind the leno threads of the catch selvage downstream of the point where the catch selvage is trimmed from the woven web, continuously as the leno threads are twisted together to form the leno binding of the catch selvage upstream of the web binding point. As a result, the leno threads are continuously bound-in and then unbound from the catch selvage without damaging or interrupting the leno threads. Thus, it is possible to achieve a closed circuit run of the leno threads, whereby each leno thread is an endless closed-loop leno thread that is recirculated from the untwisting apparatus back around to the leno selvage forming device without interruption. In this manner, it is possible to avoid the intermediate storage of the catch selvage leno threads on leno thread spools. For this purpose, the leno threads are made of a durable and high tensile strength yarn, such as a synthetic yarn material, in order to ensure a reliable, long term, continuous operation of the closed loop feed of the catch selvage leno thread.

Depending on the particular types of weft thread and leno thread materials being used, the invention can achieve a considerable cost savings per loom per year. Furthermore, processing the waste according to the invention eliminates the need for carrying out a costly disposal or recycling of the mixed-type waste, which in turn has an advantageous influence on the environment.

BRIEF DESCRIPTION OF THE DRAWINGS

In order that the invention may be clearly understood, it will now be described in connection with example embodiments, with reference to the accompanying drawings, wherein:

FIG. 1A is a schematic perspective view of an alternative embodiment of a leno thread untwisting apparatus.

DETAILED DESCRIPTION OF PREFERRED EXAMPLE EMBODIMENTS AND OF THE BEST MODE OF THE INVENTION

Figure 1:
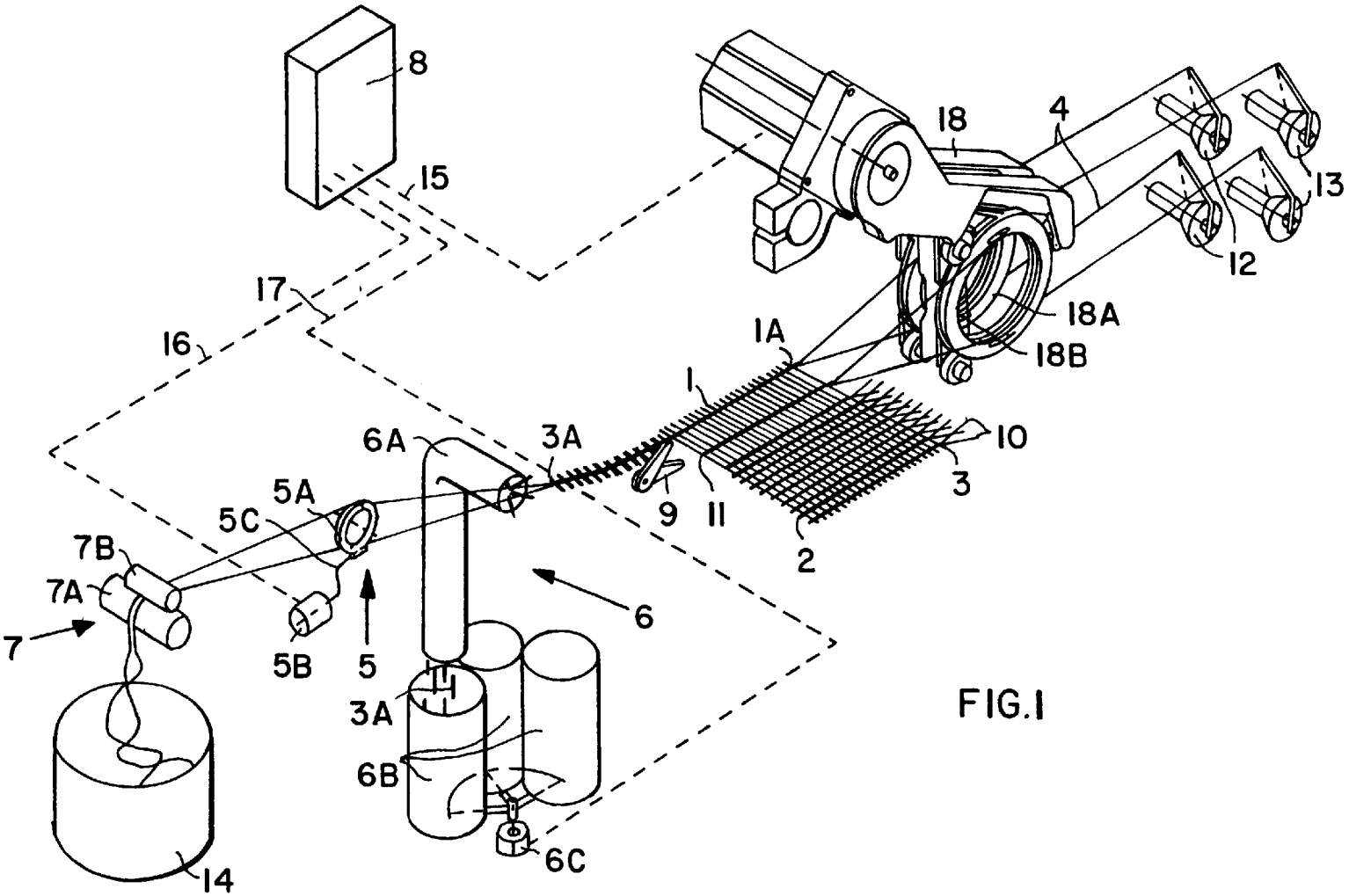
FIG. 1 is a schematic perspective view of an apparatus according to the invention for processing and producing a type-pure weft thread waste separated from a full leno bound catch selvage.

FIG. 1 schematically shows an apparatus for producing a type-pure weft thread waste from the catch selvage 1 of a woven web 2 being produced on a loom, while using leno thread spools 12 and 13 for supplying the respective leno threads 4. The apparatus is arranged on the left side of the woven web 2 in the present example, but a similar apparatus can be arranged symmetrically on the right side of the web. The loom itself is not shown here, but can be embodied in any known manner. Indicative of the location, arrangement and operation of the loom, FIG. 1 simply schematically shows a portion of the woven web 2, consisting of weft threads 3 and warp threads 10, that is being produced on the loom, and that moves in a web advance direction toward the lower left of FIG. 1. Also illustrated is a rotational leno device 18 of the loom, which is used especially in high speed looms for producing a secure and visually high-valued fabric list edge 11 as well as the catch selvage 1 by respective full leno bindings. Such an arrangement of the rotational leno device 18 is disclosed, for example, in the above mentioned German utility Model 29,708,758.

Respective leno threads 4 are pulled from respective leno thread spools 12 and are guided through the thread guide eyelets 18B of the rotating leno disks 18A of the leno device 18 for forming the catch selvage 1 respectively using full leno binding 1A. Since the leno thread spools 12 in the present embodiment are fixedly arranged at stationary locations, the rotational leno disks 18A of the leno device 18 must be operated with a cyclically reversing rotation direction to avoid twisting and binding of the leno threads 4 between the leno device 18 and the spools 12.

At a distance sufficiently downstream from the beat-up edge to ensure that the weft threads 3 have been bound in and sufficiently held under tension, a weft cutter 9 cuts the weft thread ends 3A between the fabric list edge 11 and the leno binding 1A of the catch selvage 1, so as to trim the catch selvage 1 from the woven web 2. The leno threads 4 of the catch selvage 1 then pass through a debinding or untwisting apparatus 5, which rotates or twists the threads 4 in such a manner that the full leno binding 1A is untwisted so as to release the weft thread ends 3A.

The debinding or untwisting apparatus 5 is arranged substantially linearly downstream of the point where the catch selvage 1 is trimmed from the web 2, and comprises a rotational member 5A that includes thread guide eyelets through which the leno threads 4 are received and guided to be rotated for untwisting the full leno binding 1A. Thus, the rotational member 5A may be embodied similarly to a leno disk 18A, but may have a smaller diameter for example. The rotational member 5A is driven from a rotational drive 5B, such as an electric servomotor or the like, through a flexible drive shaft 5C in the present example embodiment. Alternatively, the untwisting apparatus 5 may be embodied as a servomotor including a stator 5D and a rotor 5A directly cooperating with the stator 5D, wherein the rotor 5A is directly embodied as the rotational member 5A.

Once the weft thread ends 3A have been released from the untwisted leno binding 1A, they are collected by a waste collection apparatus 6 comprising an injector suction pipe 6A and at least one weft waste collection container 6B, arranged between the weft cutter 9 and the untwisting apparatus 5. The waste collection apparatus 6 is connected, for example by an electrical conductor or other control line 17, for control signal transmission from the loom process controller 8 in which a weft thread selection program has been stored and is being executed. Particularly, the control line 17 connects the process controller 8 to an electric motor drive 6C of the waste collection apparatus 6. A plurality of weft waste collection containers 6B are arranged on a rotatable platter or the like, which is rotationally driven by the electric motor drive 6C in accordance with control signals generated responsive to the weft thread selection program in the process controller 8.

In this manner, the collection of the weft thread ends 3A can be carried out dependent upon the weft thread selection program, whereby different types or colors of weft threads can be separately collected in respective ones of the weft waste collection containers 6B. This is especially advantageous when the woven web 2 being woven on the loom has different colors or different types of weft threads 3 being used with relatively broad spacings between color or type changes. In such a case, the respectively correct weft waste collection container 6B will be positioned under the suction pipe 6A so as to collect a type-pure or color-pure weft thread waste therein. In other words, a first one of the weft waste collection containers will collect all of the weft ends 3A of a first color or material type, a second container 6B will collect all of the weft thread ends 3A of a second color or type, and a third container 6B will collect all of the weft thread ends 3A of a third color or type.

The loom process controller 8 further provides appropriate electrical control signals for actuating or controlling especially the method steps of forming a catch selvage full leno binding 1A, trimming the catch selvage 1 from the woven web 2 by means of the weft cutter 9, and unbinding or untwisting the full leno binding 1A by means of the untwisting apparatus 5. For this purpose, the respective control signals are conducted via control lines 15 and 16 respectively to the leno device 18 and to the untwisting apparatus 5.

In this context, the untwisting of the full leno binding 1A can be carried out synchronously or asychronously relative to the formation of the leno binding 1A by means of the rotational leno device 18. In the case of an asynchronous operation, when the rotational leno device 18 is operating with reversals of the rotation direction, it is simply important to ensure that the number of forward rotations and reverse rotations of the rotating leno disk 18A of the leno device 18 is equal to the respective number of forward rotations and reverse rotations of the rotational member 5A of the untwisting apparatus 5. In this manner it is ensured that the full leno binding 1A will always be completely and reliably untwisted, and particularly the weft thread ends 3A will be completely released from the catch selvage 1 in the area of the suction provided by the suction pipe 6A of the waste collection apparatus 6. Thus, when the rotating leno disk 18A of the leno device 18 is operated with reversals of its rotation direction for forming the leno binding 1A, it is absolutely necessary that the rotational direction of the rotational member 5A of the untwisting apparatus 5 is also controlledly reversed at the appropriate times in order to untwist the full leno binding 1A. The process controller 8 will provide the necessary control signals via the control lines 15 and 16 mentioned above.

Arranged further downstream from the debinding or untwisting apparatus 5 is a leno thread drawing off apparatus 7 including a rotationally driven drawing off roller 7A and a counterpressure roller 7B, for drawing the untwisted leno threads 4 through the nip between the rollers 7A and 7B, into a leno thread collecting container 14. The driven roller 7A may actually be the cloth drawing-in roller of the loom. Instead of simply drawing the untwisted leno threads 4 into a collecting container 14, the rollers 7A and 7B can be replaced by corresponding rotationally driven spool carriers with thread spools arranged thereon, whereby the leno threads 4 would be rolled up on the spools. Then, the threads 4 could be reused as leno threads supplied from the spools in a subsequent leno binding process.

Figure 2:
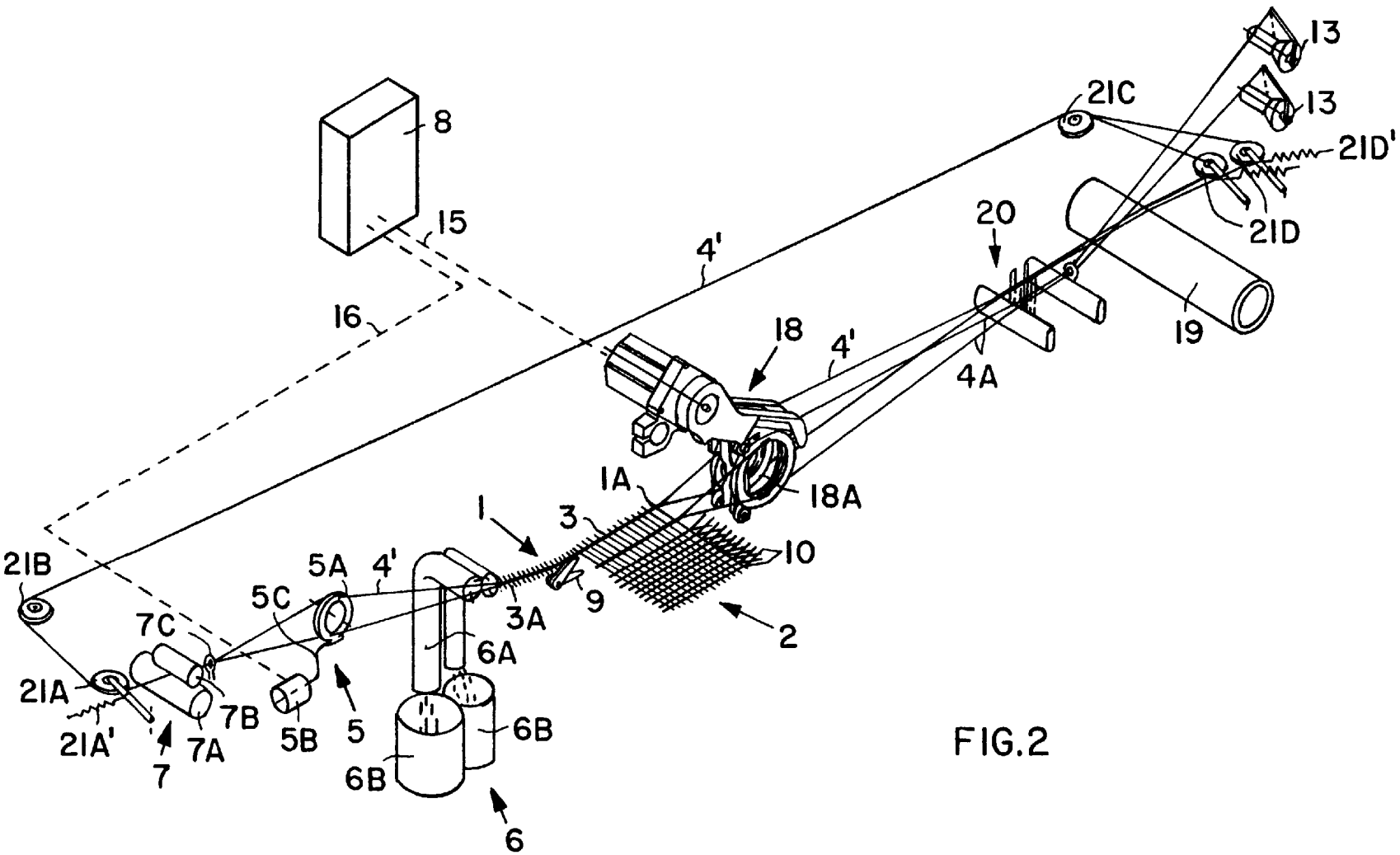
FIG. 2 is a schematic perspective view of an arrangement similar to that of FIG. 1, but avoiding the use of catch selvage leno spools and instead providing a continuous recirculating feed of endless loop leno threads for the catch selvage.

FIG. 2 relates to an embodiment of the invention providing a continuous recirculating feed of two endless closed-loop leno threads 4' for forming the catch selvage. Preferably, the threads 4' are made of a thermally fusion-weldable material, to facilitate forming the endless loops thereof. Most of the components of the embodiment of FIG. 2 correspond to those of FIG. 1, and are labelled with the same reference numbers. The operation of the apparatus according to FIG. 2 also generally corresponds to that of the apparatus shown in FIG. 1, except as follows.

The two leno threads 4' for forming the leno binding 1A of the catch selvage 1 according to FIG. 2 are endless closed-loop leno threads so that the leno spools 12 of FIG. 1 are omitted. However, the two leno threads 4A for forming the fabric list edge 11 are supplied from leno spools 13 in the usual manner. The conventional leno threads 4 and the endless leno threads 4' are guided through a leno thread monitor or stop motion 20 and from there to the rotational leno device 18, which rotates or twists the respective leno threads together to form the leno bindings of the catch selvage and of the fabric list in the usual manner. Downstream of the point at which the weft cutter 9 separates the catch selvage 1 from the woven web 2, the untwisting apparatus 5 unbinds or untwists the leno threads 4' from each other to open the leno binding 1A and release the weft thread ends 3A in the manner described above.

The waste collection apparatus 6 may correspond to that described above in connection with FIG. 1, or for example include only a single weft waste collection container 6B in the case of a weaving operation with only one color or type of weft thread. Alternatively, the sorting and separate collection of different colors or types of weft thread ends can be carried out under control of the weft selection program using different means than described above in connection with FIG. 1. For example, a plurality of suction pipes 6A may be arranged adjacent one another and leading with their respective outlet ends into respective separate weft waste collection containers 6B. The loom process controller 8 can provide proper signals via a control line 17 to actuate the appropriate suction pipe 6A at any time for collecting a single color or type of weft thread 3A. The suction pipes 6A are, for example, injector-driven suction pipes, whereby it is a simple matter to actuate a selected injector valve for operating the desired suction pipe 6A at any time.

Downstream of the untwisting apparatus 5, a leno thread drawing off apparatus 7 including rollers 7A and 7B, and further preferably including a thread gathering guide 7C preferably just up-stream of the rollers, gathers and draws off the separate leno threads 4'. Then the endless closed-loop leno threads 4' are conveyed over deflector elements such as deflecting idler rollers or pulleys 21A, 21B, 21C and 21D in sequence to be directed back to the stop motion 20 and then to the rotational leno device 18.

In this context, one or more of the deflection rollers 21A and 21D are movably arranged and biased by springs 21A' and 21D' to hold the endless closed-loop leno threads 4' under a proper tension. While the two leno threads 4' travel together over the deflection rollers 21A, 21B and 21C, they are separately guided over two separate deflection rollers 21D, which are respectively separately spring biased, so that each individual leno thread 4' is reliably held under the proper tension, even if the two threads undergo different strain elongations, for example. Between the deflection rollers 21D and the leno thread stop motion 20, the leno threads 4' may be directed and deflected over a tensioning beam 19 to apply the proper tension to the leno threads 4' at any time.

The method and apparatus of the invention have made it possible for the first time to unbind a full leno binding that tightly holds weft thread ends into a trimmed-off catch selvage, to separate the weft thread ends from the leno threads, and then to separately collect the respective unbound weft thread ends as type-pure weft thread waste. Simultaneously, the unbound leno threads may either be collected as a type-pure waste, or may be wound up on spools to be later reused as leno threads. Moreover, according to FIG. 2, the endless leno threads 4' are used continuously and recirculated, without generating any leno thread waste, and without requiring any additional steps of winding the leno threads onto spools, handling and re-fitting the spools, and the like. The spools for the catch selvage leno threads can be completely omitted.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of processing a catch selvage of a woven web, said catch selvage including weft thread ends bound by at least two leno threads that are twisted together, said method comprising the following steps:

a) untwisting said leno threads from each other so as to unbind said weft thread ends, b) separating said weft thread ends from said untwisted leno threads, and c) separately transporting away said weft thread ends and said untwisted leno threads.

2. The method according to claim 1, wherein said weft thread ends comprise a thread material different from said leno threads or have a color different from said leno threads, and wherein said method is carried out to provide said weft thread ends as an uncontaminated weft thread waste containing only said thread material of said weft thread ends and having only said color of said weft thread ends after said step c).

3. The method according to claim 1, wherein said weft thread ends include at least first weft thread ends consisting of a first thread material and second weft thread ends consisting of a second thread material, wherein said second thread material has at least one of a different color and a different material composition relative to said first thread material, and further comprising sorting and separately collecting said first weft thread ends and said second weft thread ends.

4. The method according to claim 3, wherein said sorting and separate collecting are carried out mechanically responsive to an automatic control.

5. The method according to claim 4, wherein said automatic control is provided by executing a weft thread selector program that is stored in a loom process controller.

6. The method according to claim 1, further comprising, before said step a), the preliminary steps of:

forming said catch selvage by twisting together said leno threads by rotating a leno disk of a rotational leno device that carries said leno threads, so as to form of said leno threads a full leno binding that binds said weft thread ends, and trimming said catch selvage from said woven web by cutting said weft thread ends from weft threads that are bound into said woven web.

7. The method according to claim 6, wherein said step of twisting together said leno threads by rotating said leno disk comprises intermittently reversing a rotation direction of said rotating of said leno disk, wherein said step of untwisting said leno threads from each other comprises rotating a rotational member of an untwisting apparatus that carries said leno threads, and wherein said rotating of said rotational member comprises intermittently reversing a rotation direction of said rotating of said rotational member.

8. The method according to claim 7, wherein said rotating of said rotational member of said untwisting apparatus is carried out synchronously with said rotating of said leno disk of said leno device.

9. The method according to claim 7, wherein said rotating of said rotational member of said untwisting apparatus is carried out synchronously relative to said rotating of said leno disk of said leno device.

10. The method according to claim 1, wherein said steps of separating and transporting away said weft thread ends comprise pneumatically entraining said weft thread ends in a suction air flow, and said step of transporting away said untwisted leno threads comprises mechanically drawing off said untwisted leno threads.

11. The method according to claim 1, wherein said step of transporting away said untwisted leno threads comprises drawing off said untwisted leno threads separately to separate collecting means.

12. The method according to claim 1, wherein said step of transporting away said untwisted leno threads comprises separately winding up said untwisted leno threads on respective separate leno thread spools, and further comprising reusing said leno threads wound up on said spools by unwinding said leno threads from said spools and feeding said leno threads to a leno device and forming therewith a full leno binding of a catch selvage or a fabric list edge.

13. The method according to claim 1, wherein said step of transporting away said untwisted leno threads comprises transporting said leno threads to a rotational leno device, and further comprising again twisting together said untwisted leno threads by rotating a leno disk of said leno device so as to again form a further catch selvage including weft thread ends bound by said leno threads that have been again twisted together.

14. The method according to claim 13, wherein said leno threads are respectively endless closed-loop threads, and further comprising recirculating said endless closed-loop threads repeatedly from said rotational leno device back to said rotational leno device.

15. The method according to claim 14, wherein said endless closed-loop threads consist of a thread material that is thermally fusion-weldable, and further comprising forming said endless closed-loop threads respectively by fusion-welding together two ends of a thread starting material.

16. The method according to claim 13, wherein said further catch selvage is a continuation of said catch selvage of said woven web, and wherein said method is carried out continuously with said leno threads being continuously recirculated through said steps of twisting said leno threads to form said catch selvage and untwisting said leno threads to unbind said weft thread ends, without intermediately storing said leno threads in a wound-up condition.

17. The method according to claim 13, wherein said leno threads consist of a thread material having a higher than average breaking strength and durability, and further comprising maintaining said leno threads under tension during said steps of transporting away and again twisting said untwisted leno threads.

18. The method according to claim 13, further comprising monitoring said leno threads for detecting any breakage of at least one of said leno threads.

19. A processing apparatus for processing a catch selvage of a woven web, wherein said catch selvage includes weft thread ends bound by at least two leno threads that are twisted together, wherein said processing is carried out so as to separate said weft thread ends from said leno threads, said apparatus comprising:

a weft cutter arranged and adapted to cut said weft thread ends from weft threads bound into said woven web, so as to trim said catch selvage from said woven web;

an untwisting apparatus adapted to untwist said leno threads of said catch selvage from each other, arranged along a line extending from said catch selvage downstream of said weft cutter;

a weft waste collection apparatus adapted to separate said weft thread ends from said leno threads, arranged between said weft cutter and said untwisting apparatus;

a leno thread drawing off apparatus adapted to draw off said leno threads, arranged downstream of said untwisting apparatus; and a loom process controller connected for a first control signal transmission at least to said untwisting apparatus.

20. The processing apparatus according to claim 19, wherein said untwisting apparatus comprises a rotational member adapted to guidingly receive and rotate said leno threads relative to each other, and a rotational drive connected to and adapted to rotationally drive said rotational member with a reversible rotation direction.

21. The processing apparatus according to claim 20, wherein said rotational drive comprises a separate remote electric motor, and a shaft coupling said motor to said rotational member, and wherein said loom process controller is connected for said first control signal transmission to said electric motor.

22. The processing apparatus according to claim 20, wherein said rotational drive comprises a servomotor including a stator, and said rotational member is a rotor cooperating with said stator of said servomotor.

23. The processing apparatus according to claim 19, wherein said weft waste collection apparatus comprises a suction pipe having an inlet end adapted and arranged to entrain said weft thread ends, and at least one container that is adapted to collect said weft thread ends therein and that is arranged at an outlet end of said suction pipe.

24. The processing apparatus according to claim 23, wherein said weft waste collection apparatus comprises a plurality of said containers, and a selector drive connected to said containers and adapted to selectively move a respective selected one of said containers into a position at said outlet end of said suction pipe, and wherein said loom process controller is further connected for a second control signal transmission to said selector drive.

25. The processing apparatus according to claim 23, wherein said weft waste collection apparatus comprises a plurality of said suction pipes arranged adjacent one another and a plurality of said containers respectively arranged at said outlet ends of said respective suction pipes, wherein said suction pipes are independently selectively actuatable, and wherein said loom process controller is further connected for a second control signal transmission to said weft waste collection apparatus.

26. The processing apparatus according to claim 19, wherein said drawing off apparatus comprises a cooperating pair of rollers, of which at least one roller is a driven roller.

27. The processing apparatus according to claim 26, wherein one roller of said pair is a non-driven idling counterpressure roller contacting with a counterpressure against said driven roller, and wherein said driven roller is a cloth drawing-in roller for a loom.

28. The processing apparatus according to claim 19, wherein said drawing off apparatus comprises two rotationally driven spool carriers, and two thread spools that are mounted respectively on said spool carriers and that are adapted to have said leno threads wound up thereon.

29. The processing apparatus according to claim 19, further comprising a rotational leno device including a rotational leno disk adapted to guidingly receive and relatively rotate said leno threads so as to form said catch selvage, and a plurality of thread deflector guides arranged in sequence and adapted to guide said leno threads from said drawing off apparatus back to said rotational leno device.

30. The processing apparatus according to claim 29, wherein said thread deflector guides comprise respective rotatable deflecting rollers.

31. The apparatus according to claim 30, wherein separate ones of said deflecting rollers are arranged adjacent each other directly upstream of said leno device and are each individually adapted to individually guide a single one of said leno threads.

32. The processing apparatus according to claim 29, further comprising a stop motion arranged upstream of said leno device and adapted to monitor said leno threads for detecting a leno thread break.

33. The processing apparatus according to claim 29, wherein at least one of said thread deflector guides is movably held and biased by a spring, so as to hold said leno threads under tension.

34. A combination of:

at least two leno threads which comprise respective endless closed-loop leno threads; and an apparatus for processing a catch selvage of a woven web, wherein said catch selvage includes weft thread ends bound by said at least two leno threads that are twisted together, wherein said processing is carried out so as to separate said weft thread ends from said leno threads, and wherein said apparatus comprises:

a rotational leno device including a rotational leno disk adapted to guidingly receive and relatively rotate said leno threads so as to form said catch selvage, a weft cutter arranged and adapted to cut said weft thread ends from weft threads bound into said woven web, so as to trim said catch selvage from said woven web, an untwisting apparatus adapted to untwist said leno threads of said catch selvage from each other, arranged along a line extending from said catch selvage downstream of said weft cutter, a weft waste collection apparatus adapted to separate said weft thread ends from said leno threads, arranged between said weft cutter and said untwisting apparatus, a leno thread drawing off apparatus adapted to draw off said leno threads, arranged downstream of said untwisting apparatus, a plurality of thread deflector guides arranged in sequence and adapted to guide said leno threads from said drawing off apparatus back to said rotational leno device, and a loom process controller connected for control signal transmission at least to said untwisting apparatus.

* * * * *